United States Patent [19]

Järnum

[11] 4,296,516

[45] Oct. 27, 1981

[54] VERTICALLY ADJUSTABLE BRIDGE FOR CONNECTION WITH SHIPS

[75] Inventor: Lennart Järnum, Helsingborg, Sweden

[73] Assignee: AB Jarnkonstruktioner, Helsingborg, Sweden

[21] Appl. No.: 43,836

[22] Filed: May 30, 1979

[30] Foreign Application Priority Data

Sep. 6, 1978 [SE] Sweden ..... 7809372

[51] Int. Cl.[3] ..... E01D 1/00

[52] U.S. Cl. ..... 14/71.7; 14/42

[58] Field of Search ..... 14/71.7, 69.5, 71.1, 14/71.3, 42, 43, 44, 53

[56] References Cited

U.S. PATENT DOCUMENTS

| | | | |
|---|---|---|---|
| 963,918 | 7/1910 | Miller | 14/69.5 |
| 1,358,951 | 11/1920 | Helmich | 14/42 X |
| 2,560,064 | 7/1951 | Astry | 14/71.7 X |
| 2,639,450 | 5/1953 | Ramer | 14/71.7 |
| 2,644,971 | 7/1953 | Rowe | 14/71.7 |
| 2,881,458 | 4/1959 | Rodgers | 14/71.7 |
| 2,889,565 | 6/1959 | Harty | 14/42 |
| 3,345,665 | 10/1967 | Anderson | 14/71.7 |
| 3,409,923 | 11/1968 | Walker | 14/71.7 |
| 3,570,032 | 3/1971 | Allen | 14/42 |
| 4,081,874 | 4/1978 | Artzberger | 14/71.7 |

*Primary Examiner*—Nile C. Byers, Jr.
*Attorney, Agent, or Firm*—Fleit & Jacobson

[57] ABSTRACT

A vertically adjustable bridge for connection with ships, particularly ships with their own flaps such as car ferries and the like, comprises a ramp (6) including girders and the like and has an upper surface suitable as bedding for transport. At its land side the bridge is rotatably connected to a bearing arrangement (3, 4) so that the end (9) of the bridge which in use faces the ship can be turned to a desired height within a suitable adjustment area and temporarily locked in this height position by means of supporting legs (10). The bridge comprises one or more bridge units, several bridge units being mountable side by side adjacent one another, and each bridge unit has straight sides parallel to one another. A raising and lowering arrangement (11) including the supporting legs (10) with fittings is located under the ramp (6) of the or each unit at suitable distances from both ends of the ramp and from its side edges in such a way that a plurality of identical units which are individually maneuverable can be adjusted, when necessary, at the same height close to one another to effectively widen the bridge.

10 Claims, 10 Drawing Figures

FIG. 1
(PRIOR ART)
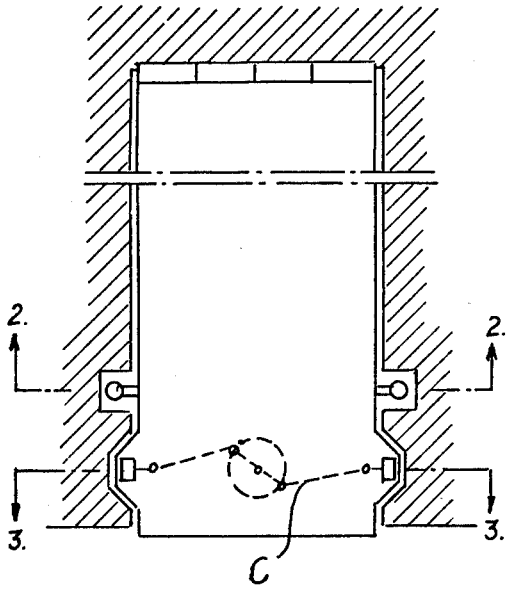
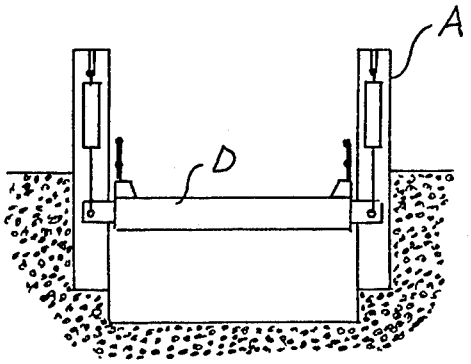
FIG. 2
(PRIOR ART)
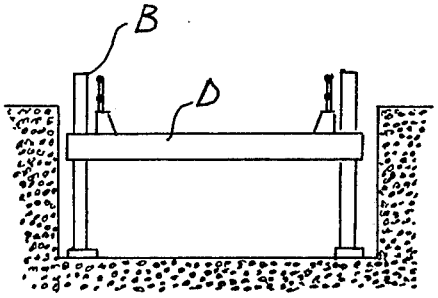
FIG. 3
(PRIOR ART)

FIG. 6
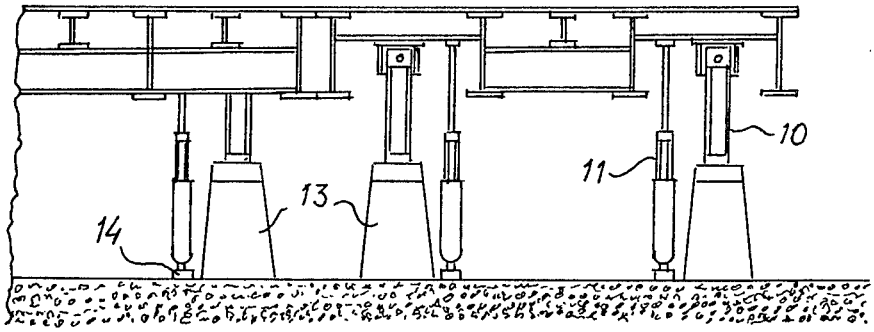
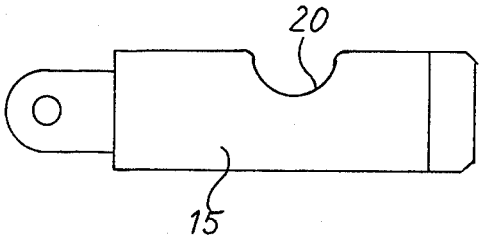
FIG. 7a
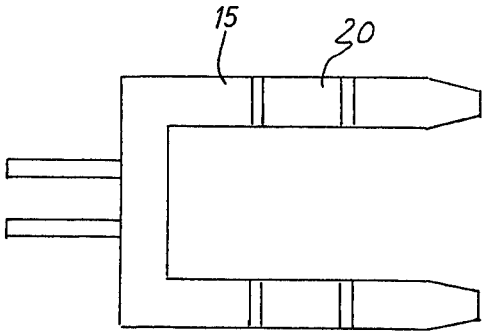
FIG. 7b

VERTICALLY ADJUSTABLE BRIDGE FOR CONNECTION WITH SHIPS

The present invention relates to a vertically adjustable bridge for transports between an abutment on one side and a ship on the other, where the height as well as the width can be varying. More particularly but not exclusively the invention relates to a vertically adjustable bridge for connection with ferries and cargo ships particularly ships having their own flaps, such as car ferries and the like.

An already known bridge flap or bridge of a conventional design, which is adjustable in a number of fixed height positions, in which transports can be transmitted to the bridge flap, consists of one single steel ramp with a lifting tower and a supporting pole on each side of the ramp. In the lifting tower a pressing or pulling lifting cylinder or an electrical hoist is coupled up.

The supporting poles generally consist of a square-iron with cylindrical holes. These poles are erected at the front corners of the flap, where they are controlled, and at the chosen height positions a circular cotter pin is brought through the holes of the pole, so that the ramp is locked in this height position.

The greatest disadvantage of a bridge flap of this kind is that it can be used only for ships, especially ferries, of a certain size, as the width of the ramp is fixed.

According to the invention, there is provided a vertically adjustable bridge for connection with ships, the bridge comprising a ramp including girders and the like and having an upper surface suitable as bedding for transport and at its land side and being rotatably connected to a permanently applied bearing arrangement, so that the end of the bridge which in use faces the ship can be turned to a desired height within a suitable adjustment area and temporarily be locked in this height position by means of supporting legs, the bridge comprising one or more bridge units, several bridge units being mountable side by side adjacent one another, wherein each bridge unit has straight sides parallel to one another and wherein a raising and lowering arrangement including the supporting legs with fittings is located under the ramp of the or each unit at suitable distances from both ends of the ramp and from its side edges in such a way that a plurality of identical units, which are individually maneuverable, can be adjusted, when necessary, at the same height close to one another, to effectively widen the bridge.

The supporting legs are preferably built according to the transverse pin principle, as there will be an angle change of the supporting legs at the change of the height position, and with a double-jaw pin in order to get stiffness sideways.

By way of example one embodiment of a bridge according to the invention will now be described with reference to the accompanying drawings in which:

FIG. 1 is a schematic top view of an earlier known type of bridge;

FIG. 2 is a view taken along line 2—2 of FIG. 1;

FIG. 3 is a view taken along line 3—3 of FIG. 1;

FIG. 6 is a sectional view along the line 6—6 of FIG. 5;

Figure 8:
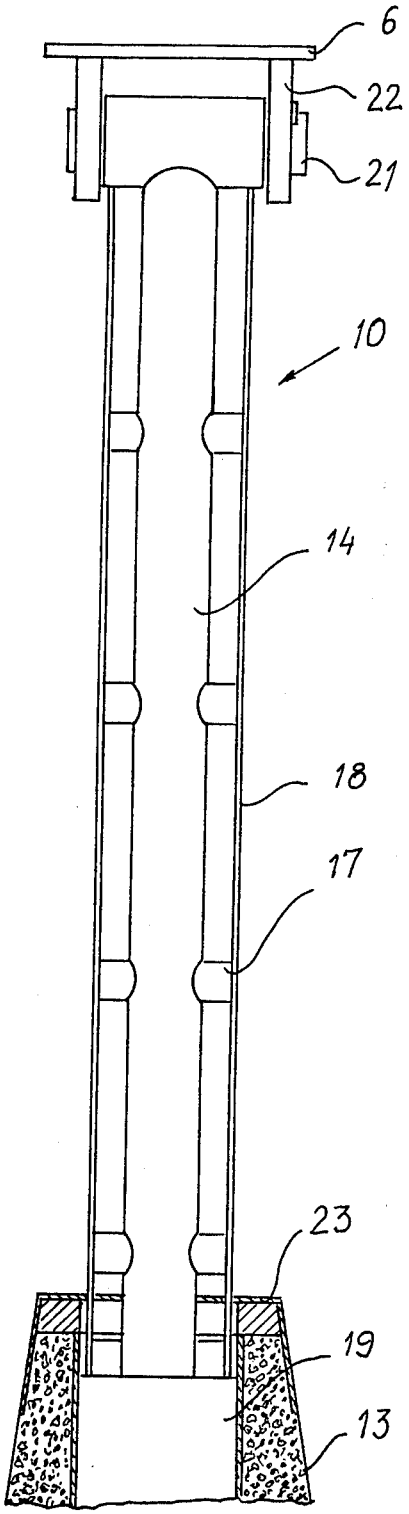

FIGS. 7(*a*) and 7(*b*) show a double-jaw pin from the side and in horizontal section, which pin is used in combination with a supporting leg;

FIG. 8 is a front view of a supporting leg; and

Figure 9:
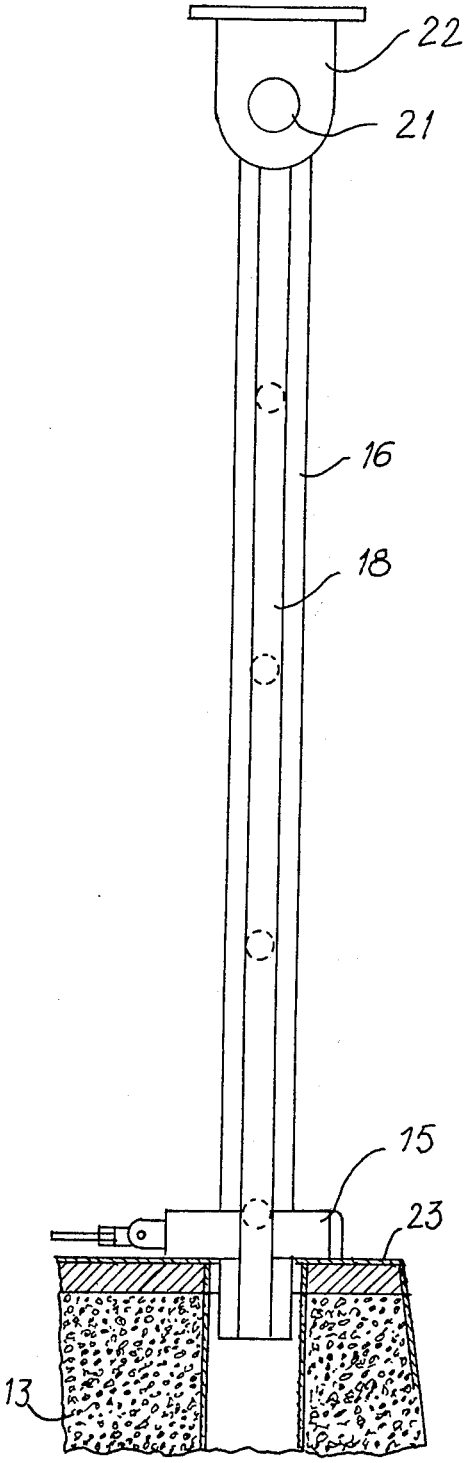

FIG. 9 is a side view of the supporting leg of FIG. 8.

It should be observed that the invention is not limited only to the described application example but that different modifications can be met with within the scope of the invention as defined by the appended claims.

FIGS. 1–3 show the arrangement at an already known bridge. Letter A indicates a lifting tower with a cylinder, letter B indicates supporting legs, which are placed at the outer corners of a ramp D, and letter C indicates schematically a cotter pin arrangement, by means of which the ramp D can be locked in a chosen height position.

Figure 4:
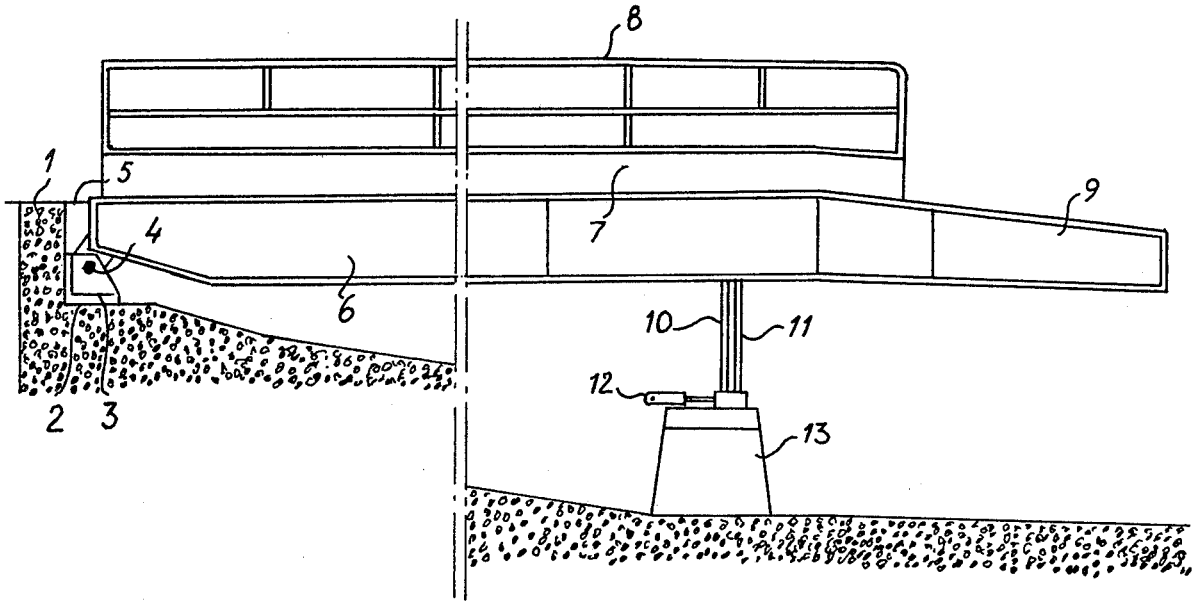
FIGS. 4 and 5 show from the side and in horizontal projection a bridge made according to the present invention.
Figure 5:
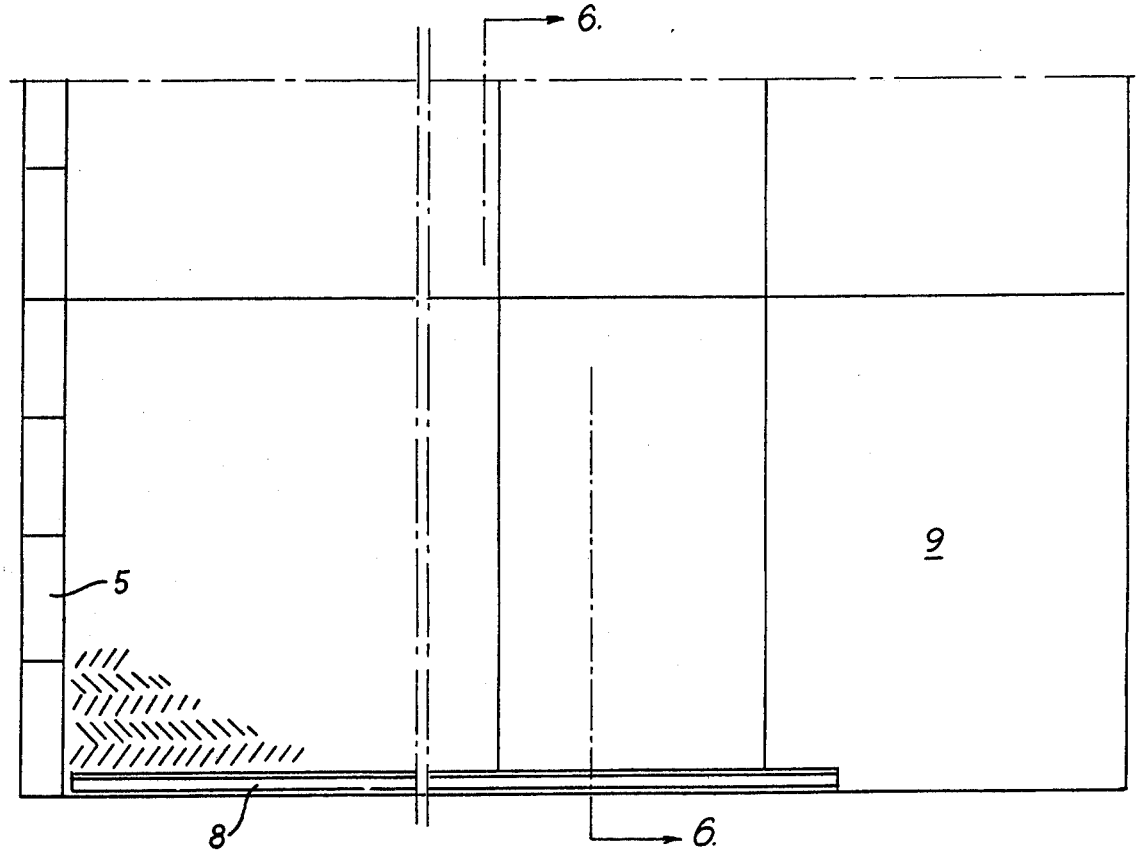

FIGS. 4–9 show a bridge according to the present invention. FIG. 4 shows a bridge element seen from the side, where a ramp 6, built up by girder elements, has been fitted with a guard 7 and a rail 8 on one side, while the other side borders upon another bridge unit. The ramp 6 is at the abutment supported by a back bearing 3 placed in an angle shelf 2 fitted with an edge lining 1. A spindle 4 transmits the turning of the ramp in the bearing 3. At the upper edges of the ramp against the ramp abutment flaps 5 are applied to cover the slot between the ramp and the upper edge of the shelf. Seen from the abutment the ramp 6 has at first a straight form extending for most of its length, after which it changes direction slightly downwards in two steps by the first and the second bucklings at a relatively small distance from each other, whereafter the utmost end is given a narrowing form and is made of a material of smaller dimensions. This part is called the deformation part and has been marked with 9. Every bridge unit is at the land side rotatably mounted in bearings at both corners.

Every bridge unit is fitted with two lifting cylinders 11 and two supporting legs 10, placed on bases 14 and 13 respectively as shown in FIGS. 4 and 6, viz. under the associated ramp and in pairs so that one lifting cylinder and one supporting leg are positioned close to each other and relatively close to the side edge of the zone between the first and the second buckling of the ramp, while the other couple is placed symmetrically to the first couple and close to the other side edge of the ramp.

In order that the arrangement according to the invention will work without trouble and that the bridge shows a good stability it is important that the supporting leg and its operation are made well adapted to their purpose. FIGS. 8 and 9 show an advantageous supporting leg construction, and FIG. 7 shows a double-jaw pin 15 having a position notch 20, intended to suit the supporting leg. The supporting leg 10 consists of a load-bearing member 16, on which pairs of transverse pins 17 are placed, the outer ends of which are connected by means of bars 18 parallel to the member 16. The transverse pins are placed on regular distances from each other along the member 16, corresponding to the height differences that will be able to be chosen and of a number corresponding to the desired number of possible height positions of the bridge unit. The member 16 is suspended in the framework of the bridge unit by means of a spindle 21 and consoles 22, so that it is rotatable in one plane parallel to the longitudinal direction of the bridge unit. The pins 17 placed two by two diametrically opposite each other relative to the member 16 are then with their centre axes parallel to the axis 21.

Every supporting leg 10 reaches down into a space 19 in a base 13 belonging to the supporting leg, which base on its upper surface is fitted with a guide plate 23 having an opening for the supporting leg that allows a certain rotation of the supporting leg during raising and lowering of the bridge unit and also serves as a base for the double-jaw pin 15, when, by influence from the pin cylinder 12, see FIG. 4, the double-jaw pin 15 is displaced into or out of engagement with the pins 17.

The two pairs of lifting cylinder/supporting leg belonging to each bridge unit are, of course, synchronously operated and independent of other bridge units.

At a change in the height of the bridge from one position to another the bridge must at first be lifted a little in order to disengage the pin 15. When the pin has been removed from the active position by the pin cylinder 12, a new position of the lifting cylinder can be adjusted somewhat above the desired new height position, after which the pin is put into the active position and the bridge is lowered to make contact with the pin. All this will, of course, be carried out automatically only by pushing the button that indicates the desired new height position.

The following construction data can be considered as suitable in a practical example.

Length of the bridge approximately 15 meters, width 4 meters. Several bridge is units can be coupled together and enlarged with five automatically adjustable height positions and total height difference approximately 3 meters. Hydraulic operation including stand-by set with complete electric control and control automatics is provided. Length of the deformation part 9 approximately 1–2 meters. Supports and construction of hydraulics is of stainless steel as well as lockings and supporting legs. Suitable dimensioning will be for an axle load of 80 tons. All lock cylinders are fitted with built-in enclosed indicators. All lifting cylinders are built down and enclosed in a glycol bath. All hydraulic pipes and indication cables are protected against objects floating around. Fully-automatic control by means of one push button for each height position is provided.

Other important and preferred features of the invention are pointed out as follows:

As noted above, the ramp 6 has at first a straight form extending for most of its length, after which it changes direction slightly downward in two steps by first and second bucklings at a relatively small distance from each other, whereafter the utmost end is given a narrowing form and is made of a material of smaller dimensions. The hydraulic lifting cylinders of the raising and lowering arrangement of the invention may be flexibly anchored in concrete bases under the slightly downwards (slightly down-bent) form part of the ramp, and the hydraulic lifting cylinders would then be placed in such a way that the contact points of the raising and lowering arrangement on the underside of the ramp are hinged and placed symmetrically in relation to the center line of the ramp and at a relatively short distance from the side edges of the ramp, in order to achieve good stability. Note FIG. 8 which shows a spindle-console hinged-type connection for one of the parts of the raising and lowering arrangement; and a similar hinged connection would be useful in permitting the lift cylinder to move upwardly, while the ramp is rotating to some degree.

In addition to the above, it is preferable that at least one of the supporting legs be arranged and suspended from the underside of the ramp, the supporting legs being adjustable in discrete, predetermined height positions of the bridge, to be able to take over the weight of the bridge in order to accommodate transport vehicles and the like. Thus, after the lifting cylinder raises the ramp, the supporting leg is adjustable and has members at desired intervals, such that the ramp may be locked into a new position by constraining the supporting leg. It is preferred to fit a ramp in a bridge unit with lifting cylinders and support legs, and to provide one maneuver cylinder for the pin of each supporting leg. The operation of the lifting cylinders together with the maneuver cylinders in locking the supporting legs into desired height positions is synchronously controlled with the assistance and control of contact-free indicators and solenoid valves suitably push-button controlled and working automatically. Further, note that all of the lifting and maneuver cylinders are most preferably enclosed for protection against mechanical and chemical attacks. All the lockings, supporting legs, and metal parts at the bases are most preferably formed of stainless steel; and all hydraulics and indication cables involved are most preferably mechanically protected against ice and floating articles, by any protection means conventionally known in the art.

In one aspect of the operation of the system for the present invention, adjustment to a new height position is initiated by a signal through a push-button control which signal is caused by the pushing of a button for a desired height position. The ramp being positioned will then be raised, for example, approximately 200 mm by means of its lifting cylinders, after which the action of the lifting cylinders is stopped. Then the pin cylinders are arranged to pull the double-jaw pins out of engagement with the supporting legs. At this point, a signal is given to adjust the ramp by means of the lifting cylinders to approximately 200 mm above the new height position, after which the pin cylinders put the pins back in the supporting legs, which are then arranged, together with the ramp to be automatically lowered until they come into contact with the pins.

An advantage of this embodiment of a bridge according to the invention is that it allows simple alteration of the width of a bridge flap step by step. This is achieved by arranging several uniform bridge units next to each other, where each bridge unit has its own lifting cylinders and supporting legs applied under the bridge unit in question without pushing out above it. In order to get the sufficient width of the transport path a sufficient number of bridge elements are adjusted on the same level. If a sufficient number of bridge units are available one can also unload for instance two ships at a time, for instance by locating three bridge units in a height position of +3 meters and two bridge units in a height position of +2 meters.

Another advantage of this embodiment of the present invention is that it is space-saving, as the earlier high lifting towers and supporting poles have now disappeared and been placed under the ramp, where they also are sheltered to a greater degree.

I claim:

1. A vertically adjustable bridge for connection with ships comprising a plurality of bridge units, each bridge unit having a ramp including girders and an upper surface suitable as bedding for transport and a land side end rotatably connected to a permanently applied bearing arrangement, the other end of the bridge unit being adjustable to a desired height within a suitable adjustment range and being temporarily lockable in the adjusted position, supporting legs and locking means cooperating with the legs for locking the other end of the bridge unit in the adjusted position, the bridge units being mountable side by side adjacent one another, each bridge unit having straight sides parallel to one another, a raising and lowering arrangement including the supporting legs with fittings located under the ramps of each unit at suitable distances from both ends of the ramp and from its side edges in such a way that a plurality of units, which are individually maneuverable, can be adjusted, when necessary, at the same height close to one another, to effectively widen the bridge.

2. A bridge as claimed in claim 1, having a mainly straight upper surface adjacent the land side end, the upper surface near the other end turning to define a slightly down-bent form, and being suitably finished with a vertically narrowing deformation part of relatively smaller material dimensions, the raising and lowering arrangement including hydraulic lifting cylinders flexibly anchored in concrete bases under the bent form and placed in such a way that the contact points of the raising and lowering arrangement on the underside of the ramp are hinged and placed symmetrically in relation to the centre line of the ramp and at a relatively short distance from the side edges of the ramp in order to achieve a good stability.

3. A bridge as claimed in claim 2, wherein, close to each lifting cylinder, one of the supporting legs is arranged and suspended from the underside of the ramp, the supporting legs being adjustable in discrete, predetermined height positions of the bridge to be able to take over the weight of the bridge with passing transport vehicles and the like.

4. A bridge as claimed in claim 1, 2, or 3, wherein each supporting leg comprises a base positioned underneath the ramp and ladderlike portion supported by the base, the ladder-like portion being fitted with a central bearing member on which pairs of transverse pins are supported on both sides at regular height distances and being suspended from the underside of the ramp and pivotable in a vertical plane parallel to the longitudinal direction of the bridge and extendable down into a space in the base, an associated hydraulic lifting cylinder being erected adjacent the base, the base on its upper side having guide means with a recess for guiding movement of the supporting leg into and out of the space, a horizontally displaceable double-jaw pin having arms and being arranged above the guide means, so that the arms of the double-jaw pin can be located in a support position under each pin of the transverse pins placed on each side of the bearing member, the arms at the support position being countersunk, so that the supporting leg as well as the ramp is supported by the double-jaw pin, which in its turn rests upon the guide means of the base.

5. A bridge as claimed in claim 4 wherein each supporting leg is suspended from a suspension axle, the centre axes of the pins being parallel to the associated suspension axle of the supporting leg, the centre line of which axle being at right angles to the longitudinal direction of the ramp and the displacing directions of the double-jaw pin being mainly parallel to the longitudinal direction of the ramp.

6. A bridge as claimed in claim 5, wherein the double-jaw pin is arranged to be pushed respectively towards or from its supporting leg, so that it will move respectively into or out of engagement with the pins of the supporting leg with assistance of a manoeuver cylinder and the pin being guided by a slide.

7. A bridge as claimed in claim 6 wherein each bridge unit is fitted with two hydraulic lifting cylinders and one maneuver cylinder for the pin of each supporting leg, all of which are synchronously controlled with the assistance and control of contact-free indicators and solenoid valves suitably push-button controlled and working automatically.

8. A bridge as claimed in claim 4, wherein the ramps have straight sides for mounting a stand-up guard and a protection rail, the sides having upper edges fitted with flanges and made with fastening holes.

9. A bridge as claimed in claim 6, wherein all the lifting and maneuver cylinders are enclosed for protection against mechanical and chemical attacks, all the lockings, supporting legs, and metal parts at the bases are formed of stainless steel and all hydraulics and indication cables are mechanically protected against ice and floating articles.

10. A bridge as claimed in claim 6, wherein at adjustment of a new height position initiated by a signal through pushbutton control and pushing of a button for desired height position, the ramp being positioned is arranged to be raised for approximately 200 mm by means of its lifting cylinders, after which these are stopped, and the pin cylinders are arranged to pull the double-jaw pins out of engagement with the supporting legs, after which a signal is given to adjust the ramps by means of the lifting cylinders to approximately 200 mm above the new height position, after which the pin cylinders put the pins back in the supporting legs, which are then arranged, together with the ramp, to be automatically lowered until they get into contact with the pins.

* * * * *